US007213374B2

(12) United States Patent
Harris et al.

(10) Patent No.: US 7,213,374 B2
(45) Date of Patent: May 8, 2007

(54) HINGE FOR AN ENCLOSURE

(76) Inventors: David Joseph Harris, 668 Bridgeview Dr., Muskegon, MI (US) 49441; William Jay Kelley, 216 Dryden St., Hart, MI (US) 49420; Daniel Scott Sommerfeld, 10536 W. H. Ave., Kalamazoo, MI (US) 49009

( * ) Notice: Subject to any disclaimer, the term of this patent is extended or adjusted under 35 U.S.C. 154(b) by 395 days.

(21) Appl. No.: 10/863,652

(22) Filed: Jun. 8, 2004

(65) Prior Publication Data

US 2005/0284034 A1 Dec. 29, 2005

(51) Int. Cl.
*E04B 1/344* (2006.01)

(52) U.S. Cl. ..... 52/79.1; 52/34; 52/71; 16/234; 16/250; 312/326

(58) Field of Classification Search ..... 52/32, 52/34, 64, 71; 312/262, 326, 321.5; 16/234, 16/250, 251; 220/4.34, 263
See application file for complete search history.

(56) References Cited

U.S. PATENT DOCUMENTS 3,086,628 A * 4/1963 Robinson ..... 49/399
3,177,532 A * 4/1965 Domsic et al. ..... 49/381
3,404,486 A * 10/1968 Kellerhals ..... 49/386
D214,886 S * 8/1969 Katona ..... D25/16
4,098,424 A * 7/1978 Liebscher et al. ..... 220/4.29
4,434,524 A * 3/1984 Gilchrist ..... 16/250
4,789,075 A * 12/1988 Sun ..... 220/4.34
5,107,652 A * 4/1992 Sosa ..... 52/578
5,191,989 A * 3/1993 Butler ..... 220/4.34
5,605,344 A * 2/1997 Insalaco et al. ..... 280/47.34
5,975,660 A * 11/1999 Tisbo et al. ..... 312/263
6,086,073 A * 7/2000 Tisbo et al. ..... 280/47.26
6,099,092 A * 8/2000 Uffner et al. ..... 312/108
6,766,541 B2 * 7/2004 Adams et al. ..... 4/449
6,796,087 B1 * 9/2004 Greene ..... 52/32
6,802,158 B1 * 10/2004 Greene ..... 52/79.5
6,892,497 B2 * 5/2005 Moon et al. ..... 52/79.1

* cited by examiner

*Primary Examiner*—Robert Canfield
(74) *Attorney, Agent, or Firm*—Brinks Hofer Gilson & Lione

(57) ABSTRACT

A hinge for an enclosure is disclosed. The hinge includes a hinge rod and a bushing. The hinge rod is secured to one of a door and a door jamb of the enclosure. The bushing is secured to the other of the door and the door jamb of the enclosure. Moreover, the hinge rod slidably engages the bushing to allow the door to pivot about the door jamb.

16 Claims, 3 Drawing Sheets

HINGE FOR AN ENCLOSURE

TECHNICAL FIELD

The present invention relates to devices for pivotably attaching lids or doors to an enclosure. Typically, such devices allow the lid or door to pivot about its longitudinal edge.

BACKGROUND

Enclosures such as storage sheds, temporary shelters, and portable restrooms typically have a plurality of sides walls, a roof, a floor and a lid or a door which together define an interior space. Typically, the lid or door is pivotally attached along an edge to one of the sides of the enclosure. If the enclosure is a temporary shelter or portable restroom, the door would be pivotally attached along its edge to a door jamb. Many different hinge devices are known in the art to pivotally secure the lid or door to the enclosure. For example, a typical hinge device includes first and second plates joined by a pin where the first plate is attached to the door jamb or side wall of the enclosure and the second plate is attached to the lid or door. The hinge plates are generally attached using rivets or screws. Typically, multiple hinges are disposed along the edge of the lid or door to pivotably secure same to the side wall or door jamb of the enclosure.

While prior art methods for attaching lids or doors to enclosures achieve their intended purpose, problems still exist. For example, over time the door or lid may sag or loosen because it is only attached to the side wall or door jamb of the enclosure at discrete locations along the edge of the side wall or door jamb. Further, it has been observed that enclosures made of plastic over time will wear at the hinge attachment locations causing the door or lid to sag and pull away from the hinge device.

Therefore, a new and improved device for attaching a lid or a door to an enclosure is needed. The new and improved device should prevent the door or lid from sagging and pulling away from the side wall or door jamb of the enclosure.

SUMMARY

In an aspect of the present invention a hinge for an enclosure is provided. The hinge includes a hinge rod and a bushing. The hinge rod is secured to one of a door and a door jamb of the enclosure. The bushing is secured to the other of the door and the door jamb of the enclosure. Further, the hinge rod slidably engages the bushing to allow the door to pivot about the door jamb.

In another aspect of the present invention, the bushing includes a through bore for receiving the hinge rod therethrough.

In still another aspect of the present invention, the bushing is secured to the doorjamb.

In still another aspect of the present invention, the hinge rod is secured to the door.

In still another aspect of the present invention, the hinge rod has a length that is substantially equal to the length of the jamb.

In still another aspect of the present invention, the bushing includes a bushing base that supports a bushing member having a generally cylindrical bore.

In yet another aspect of the present invention, the door includes a plurality of finger members having apertures for receiving the hinge rod.

In yet another aspect of the present invention, the doorjamb includes a plurality of finger members that interlace with the plurality of finger members of the door.

In yet another aspect of the present invention, the bushing is disposed in at least one of the plurality of finger members of the doorjamb.

In still another aspect of the present invention, an enclosure is provided. The enclosure includes a plurality of side walls, a back wall, a roof, a door, and a door jamb. The back wall is joins the plurality of side walls along an edge thereof. The roof joins the plurality of side walls and back wall along a peripheral edge thereof. The door has a hinge rod attached to a longitudinal edge of the door. The door jamb has a bushing attached thereto. The bushing slidably engages the hinge rod to allow pivotal movement of the door about the longitudinal edge of the door.

In still another aspect of the present invention, the door jamb is a dual wall construction that defines an interior door jamb space.

In still another aspect of the present invention, the bushing is disposed within the interior door jamb space of the door jamb.

In yet another aspect of the present invention, three bushings each of which are disposed in a corresponding one of the plurality of finger members of the door jamb.

These and other aspects and advantages of the present invention will become apparent upon reading the following detailed description of the invention in combination with the accompanying drawings.

DESCRIPTION

Figure 1:
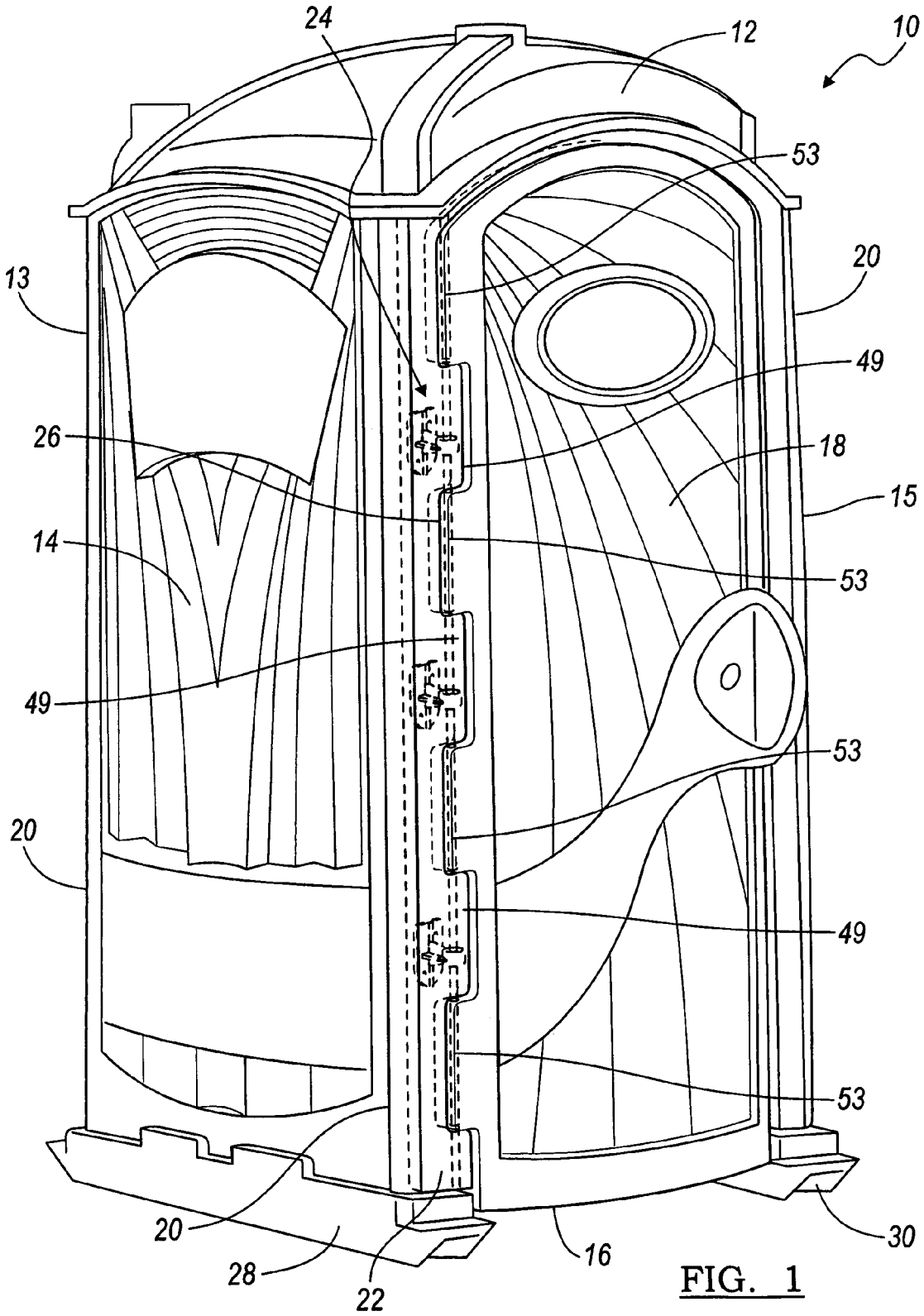
FIG. 1 is a perspective view of an enclosure or temporary shelter such as a portable restroom having sides walls, a roof, a floor and a door defining an interior space, wherein the door is pivotably attached to a door jamb, in accordance with the present invention.

Referring now to FIG. 1, an enclosure is illustrated in perspective view and herein referenced by numeral 10, in accordance with and embodiment of the present invention. Enclosure 10 may be used for many purposes including but not limited to a storage shed, a temporary shelter or a portable restroom facility. Generally, enclosure 10 includes a top or roof 12, sides walls 13, 14 and 15, bottom or floor 16 and door or lid 18. While only one side wall 14 is illustrated, it should be understood that a substantially similar side wall 15 opposite side wall 14 would be provided and join a rear or back side wall 13 (not shown). Generally, roof 12, side walls and back wall 13, 14 and 15 and bottom 16 join at their edges to define an interior space.

In an embodiment of the present invention, enclosure 10 is fitted with a pair of skids 28 and 30 to allow enclosure 10 to be easily transported or slid across a support surface. Enclosure 10 may include corner moldings 20 that join the edges of side walls and back wall 13, 14 and 15 of enclosure 10. Door 18 is pivotally fixed to a door jamb 22, as will be described in detail below. Door jamb 22 is secured along its perimeter to side walls 14 and 15 using for example, corner molding 20. Of course, other attachment means may be used including but not limited to screws, bolts, rivets and the like.

Door jamb 22 is fitted with a hinge device 24 for pivotably securing door 18 along a longitudinal edge 26 to door jamb 22. Thus, door 18 is allowed to pivot along edge 26 between an open and closed position allowing entry end exit to and from enclosure 10.

Figure 2:
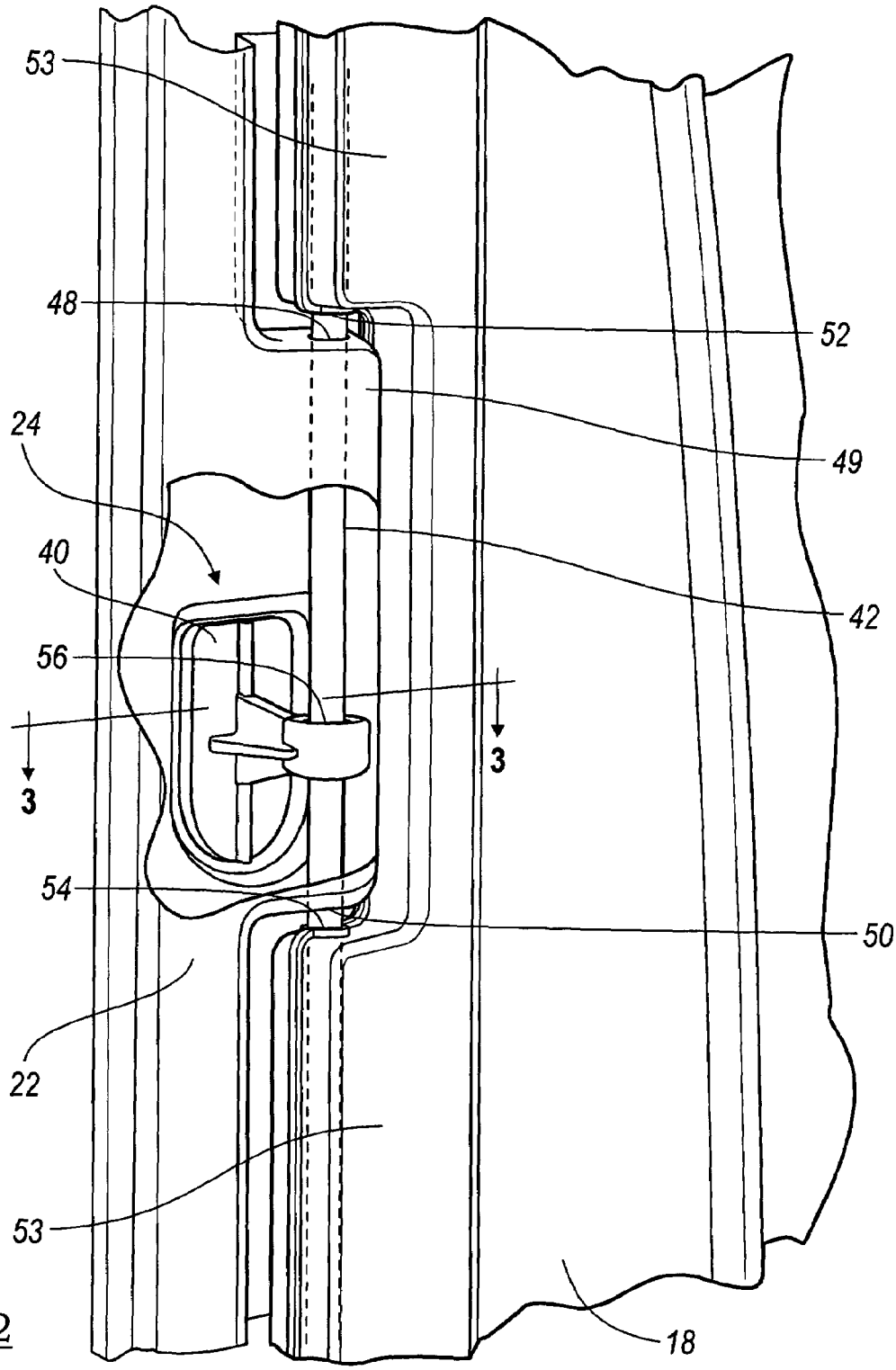
FIG. 2 is a partial cutaway view of the door jamb and door of the enclosure and further illustrating a hinge device for pivotably attaching the door to the doorjamb, in accordance with the present invention.

Referring now to FIGS. 1 and 2, a partial cutaway view of door 18 and door jamb 22 is illustrated, in accordance with an embodiment of the present invention. As previously stated, door 18 is pivotably secured to door jamb 22 by a hinge device 24. Hinge device 24 includes a bushing 40 and a hinge rod 42. As illustrated in FIG. 1, several hinge devices 24 may be disposed along edge 26 and within door jamb 22 to pivotally secure door 18 to the door jamb. While FIG. 1 depicts three hinge devices spaced apart vertically along door jamb 22, the present invention contemplates the use of additional hinge devices 24 or fewer hinge devices 24 for pivotably mounting and securing door 18 to door jam 22.

Figure 4:
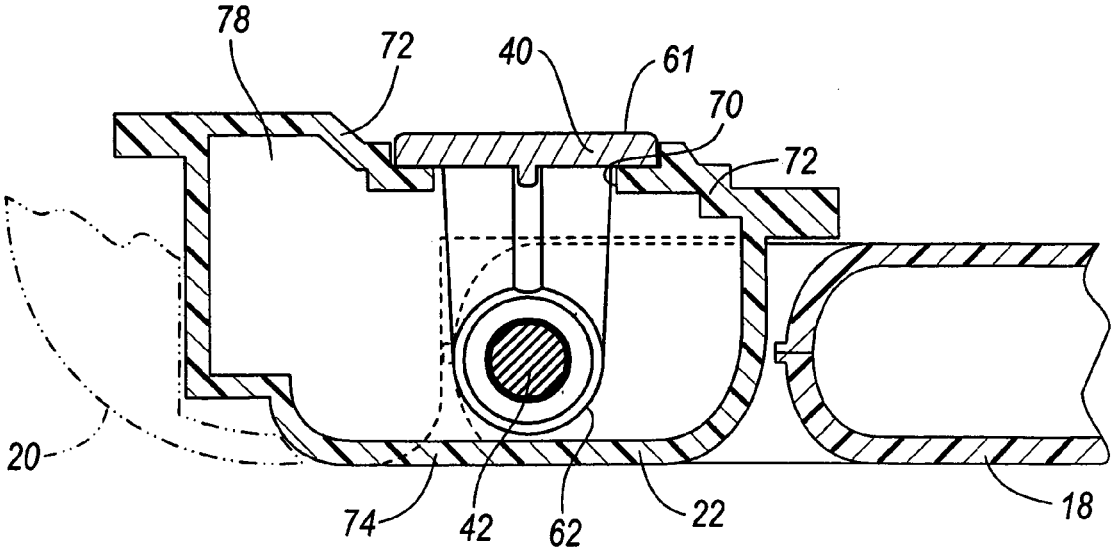
FIG. 4 is a cross-sectional view through the door jamb, door, and hinge device at a location indicated in FIG. 2, in accordance with the present invention.

In an embodiment of the present invention door jamb 22 has a dual wall construction having an inner and outer walls 72, 74. Bushing 40 is inserted into an aperture 70 in inner wall 72 (as shown in FIG. 4) and resides in the interior space between the inner and outer walls. Bushing 40 is secured to door jamb 22 using conventional screws or rivets.

As illustrated in FIGS. 1 and 2, a plurality of finger members 49 extending from door jamb 22 toward door 18. Each finger member 49 have through apertures 48 and 50. Hinge rod 42 is threaded through apertures 48 and 50 provided in each finger member 49 of door jamb 22. Additionally, a plurality of finger members 53 extend from door 18 toward door jamb 22 and interlace with the finger members 49 of door jamb 22. Hinge rod 42 is also threaded through apertures 52 and 54 disposed in finger members 53 of door 18. Further, hinge rod 42 is threaded through a cylindrical through bore 56 provided in bushing 40. By the interaction of hinge rod 42 with threaded through apertures 52, 54 in finger members 53 and bushing 40 door 18 is allowed to pivot about it longitudinal edge 26. Moreover, bushing 40 prevents the elongation or widening of apertures 48 and 50 in finger members 49 of door jamb 22 preventing sagging of door 18 relative to door jamb 22.

Figure 3:
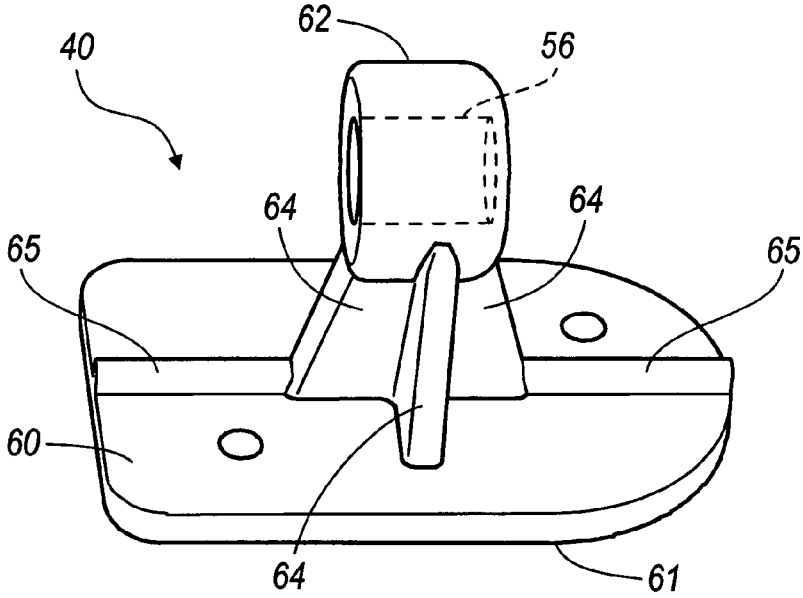
FIG. 3 is a perspective view of the bushing of the hinging device for securing the door or lid to the enclosure, in accordance with the present invention.

Referring now to FIG. 3, a magnified perspective view of bushing 40 is illustrated in accordance with an embodiment of the present invention. Bushing 40 includes a base 60 that supports a bushing member 62. Base 60 is generally planar having a flat bottom surface 61. Additionally, ribs 65 may be formed in base 60 to prevent twisting or bending of base 60. Bushing member 62 is attached to base 60 through a plurality of rib walls 64. Rib walls 64 provide the structural support for bushing member 62 and position the bushing member 62 at a desired distance from base plate 60. As previously described, a generally cylindrical through bore 56 is provided in bushing member 62 for receiving hinge rod 42. Hinge rod 42 slidably and rotatably engages through bore 56 and is allowed to freely rotate within through bore 56. Bushing 40 may be made of any suitable material that does not yield under normal operation and extended use of door 18. For example, bushing 40 may be a cast or machined metal or a composite plastic such as a fiber reinforced plastic.

Referring now to FIG. 4, a cross-sectional view through the door jamb 22 and door 18 is illustrated, in accordance with an embodiment of the present invention. As illustrated, door jamb 22 has an inner wall 72 and an outer wall 74 that defines an interior space 78. As previously described, aperture 70 is provided in inner wall 72 and bushing 40 is positioned within aperture 70 door jamb 22 and extends into interior space 78. Bushing member 62 is disposed a predefined distance from base plate 60 to align through bore 56 with apertures 48, 50, 52 and 54 in door jamb 22 and door 18. Accordingly, hinge rod 42 once threaded through apertures 48, 50, 52 and 54 in jamb 22 and door 18 and through bore 56 form hinge device 24 to pivotably secure door 18 to doorjamb 22.

As any person skilled in the art of devices for attaching an enclosure member such as lids and doors to an enclosure will recognize from the previous detailed description and from the figures and claims, modifications and changes can be made to the preferred embodiments of the invention without departing from the scope of this invention defined in the following claims.

The invention claimed is:

1. A hinge for an enclosure, the hinge comprising:

a hinge rod secured to one of a door and a door jamb of the enclosure; and the other of the door and the door jamb having a dual wall construction and defining an interior space;

a bushing disposed within the interior space, and wherein the hinge rod slidably engages the bushing to allow the door to pivot about the door jamb.

2. The hinge of claim 1 wherein the bushing includes a through bore for receiving the hinge rod therethrough.

3. The hinge of claim 1 wherein the bushing is secured to the interior space within the door jam.

4. The hinge of claim 1 wherein the hinge rod is secured to the interior space within the door.

5. The hinge of claim 1 wherein the hinge rod has a length that is substantially equal to the length of the jamb.

6. The hinge of claim 1 wherein the bushing includes a bushing base that supports a bushing member having a generally cylindrical bore.

7. The hinge of claim 1 wherein the door includes a plurality of finger members having apertures for receiving the hinge rod.

8. The hinge of claim 7 wherein the door jamb includes a plurality of finger members that interlace with the plurality of finger members of the door.

9. The hinge of claim 8 wherein the bushing is disposed in at least one of the plurality of finger members of the door jamb.

10. An enclosure comprising:

a plurality of side walls:

a back wall connected to the plurality of side walls;

a roof joined to the plurality of side walls and back wall generally along a peripheral edge thereof;

a door having a hinge rod attached to the door generally at a longitudinal side of the door; and a door jamb having a bushing attached thereto, wherein the bushing engages the hinge rod to allow pivotal movement of the door about the hinge rod, the door jamb having a dual wall construction that defines an interior door jamb space and the bushing being disposed within the interior door jamb space of the door jamb.

11. The enclosure of claim 10 wherein the bushing includes a through bore for receiving the hinge rod therethrough.

12. The enclosure of claim 10 wherein the hinge rod has a length that is substantially equal to the length of the jamb.

13. The enclosure of claim 10 wherein the bushing includes a bushing base that supports a bushing member having a generally cylindrical bore.

14. The enclosure of claim 10 wherein the door includes a plurality of finger members having apertures for receiving the hinge rod.

15. The enclosure of claim 14 wherein the door jamb includes a plurality of finger members that interlace with the plurality of finger members of the door.

16. The enclosure of claim 15 further comprising three bushings each of which are disposed in a corresponding one of the plurality of finger members of the door jamb.

* * * * *